US005947099A

United States Patent [19]

Derus

[11] Patent Number: 5,947,099

[45] Date of Patent: Sep. 7, 1999

[54] EXTENDED FORK COMPOUND ARCHERY BOW

[75] Inventor: Michael W. Derus, New Port Richey, Fla.

[73] Assignee: Golden Eagle Satellite Archery, LLC., Odessa, Fla.

[21] Appl. No.: 09/266,536

[22] Filed: Mar. 11, 1999

[51] Int. Cl.[6] ..... F41B 5/10

[52] U.S. Cl. ..... 124/25.6

[58] Field of Search ..... 124/23.1, 25.6

[56] References Cited

U.S. PATENT DOCUMENTS

| | | | |
|---|---|---|---|
| 3,958,551 | 5/1976 | Ketchum | 124/25.6 |
| 4,561,413 | 12/1985 | Jennings . | |
| 4,644,929 | 2/1987 | Peck | 124/25.6 X |
| 4,917,070 | 4/1990 | Townsend | 124/25.6 X |
| 5,429,106 | 7/1995 | Martin et al. | 124/25.6 X |
| 5,534,213 | 7/1996 | Epling | 264/328.1 |
| 5,720,267 | 2/1998 | Walk | 124/23.1 |
| 5,722,380 | 3/1998 | Land et al. | 124/25.6 |

*Primary Examiner*—John A. Ricci
*Attorney, Agent, or Firm*—Harris Beach & Wilcox, LLP.

[57] ABSTRACT

A novel limb construction for a compound archery bow including a handle riser and a bow limb with a base portion attached to the handle riser. The bow limb comprises a pair of resilient limb members connected to and integral with the base portion of the limb. Where the base portion joins two independent limb portions, a fork is formed. The bow limb also includes a working portion, which is an area of reduced thickness between the base of the limb and pulley. The majority of the flexing of the bow limb occurs at this working portion during the draw of the bowstring. In the present invention, the fork is on the base side of the working portion rather than the pulley side of the working portion, as with bows of the past. This design provides a lightweight bow which is strong and has many fewer parts compared to the split limbs of the past. The split limbs are stronger than a solid limb and can be made from various types of fiber reinforced plastics such as short and long fiber reinforced nylon.

5 Claims, 3 Drawing Sheets

EXTENDED FORK COMPOUND ARCHERY BOW

BACKGROUND OF THE INVENTION

1. Scope of the Invention

This invention relates to a limb construction in a compound archery bow, and in particular, to a bow limb having a fork which extends past the working portion of the bow limb.

2. Description of the Invention Background

Compound archery bows are often used for game hunting and target shooting. In such use the bows may be held for long periods of time for aiming. It is therefore desirable for bows to be lightweight for ease of carrying and aiming. It is also desirable to have bows which are durable, but inexpensive to manufacture. Traditionally, compound archery bows use a bowstring rigged over pulleys. The pulleys are mounted on an axle at the end of each limb. The bow limb is forked at its outer end to accommodate the pulley. When the bowstring is drawn, forces acting on the pulley axle cause the limbs to flex and the pulley to rotate.

In the past, bow limbs have been constructed in one of two configurations. In one, the bow limb was solid until it reached the fork which is adjacent the pulley. In this configuration, the limbs are relatively heavy and provide a low strength to weight ratio. In the other, the bow limb comprised a pair of independent and separate limb members which were clamped together adjacent the handle of the bow such as found in U.S. Pat. No. 5,720,267 to Walk. While this independent and separate limb design provides for a lightweight bow, this construction requires numerous parts for clamping and is labor-intensive to manufacture.

A bow is needed which is strong, durable, lightweight and inexpensive to manufacture. A bow is also needed which has a relatively high strength to weight ratio. The present invention solves these problems present with prior art bows.

SUMMARY OF THE INVENTION

The present invention overcomes the aforementioned drawbacks of the bow designs in the past by providing a novel limb construction for a compound archery bow. The limb construction includes a handle riser and a bow limb with a base portion attached to the handle riser. The bow limb comprises a pair of resilient limb members connected to and integral with the base portion of the limb. Where the base portion joins two independent limb portions, a fork is formed. The bow limb also includes a working portion, which is an area of reduced thickness between the base of the limb and pulley. The majority of the flexing of the bow limb occurs at this working portion during the draw of the bowstring. In the present invention, the fork is on the base side of the working portion rather than the pulley side of the working portion, as with bows of the past. This design provides a lightweight bow which is strong and has many fewer parts compared to the split limbs of the past. Complicated clamping mechanisms, such as the one found in U.S. Pat. Nos. 5,720,267 and 5,722,380 are not necessary. The applicant has determined that the extended fork configuration is stronger than a solid limb having the same thickness. Thus, for a given thickness of limb, the extended fork limb is more durable than a solid limb bow, with the added advantage that the extended fork bow is lighter in weight and utilizes less material.

Because the split limbs are stronger than a solid limb, the limbs can be made from various types of fiber reinforced plastics such as short and long fiber reinforced nylon. The present invention greatly expands the materials which will provide bow limbs of acceptable strength. U.S. Pat. No. 5,534,213 teaches that only long fiber reinforced plastics are suitable for use in bow limbs. That patent teaches that short fibers do not provide limbs which are strong enough to withstand the stresses to which bow limbs are subjected. However, the inventor has discovered that with the split limb design of the present invention, both short and long fiber reinforced nylon will provide limbs capable of withstanding the forces nomally encountered by such limbs.

DETAILED DESCRIPTION OF THE PREFERRED EMBODIMENT

Figure 1:
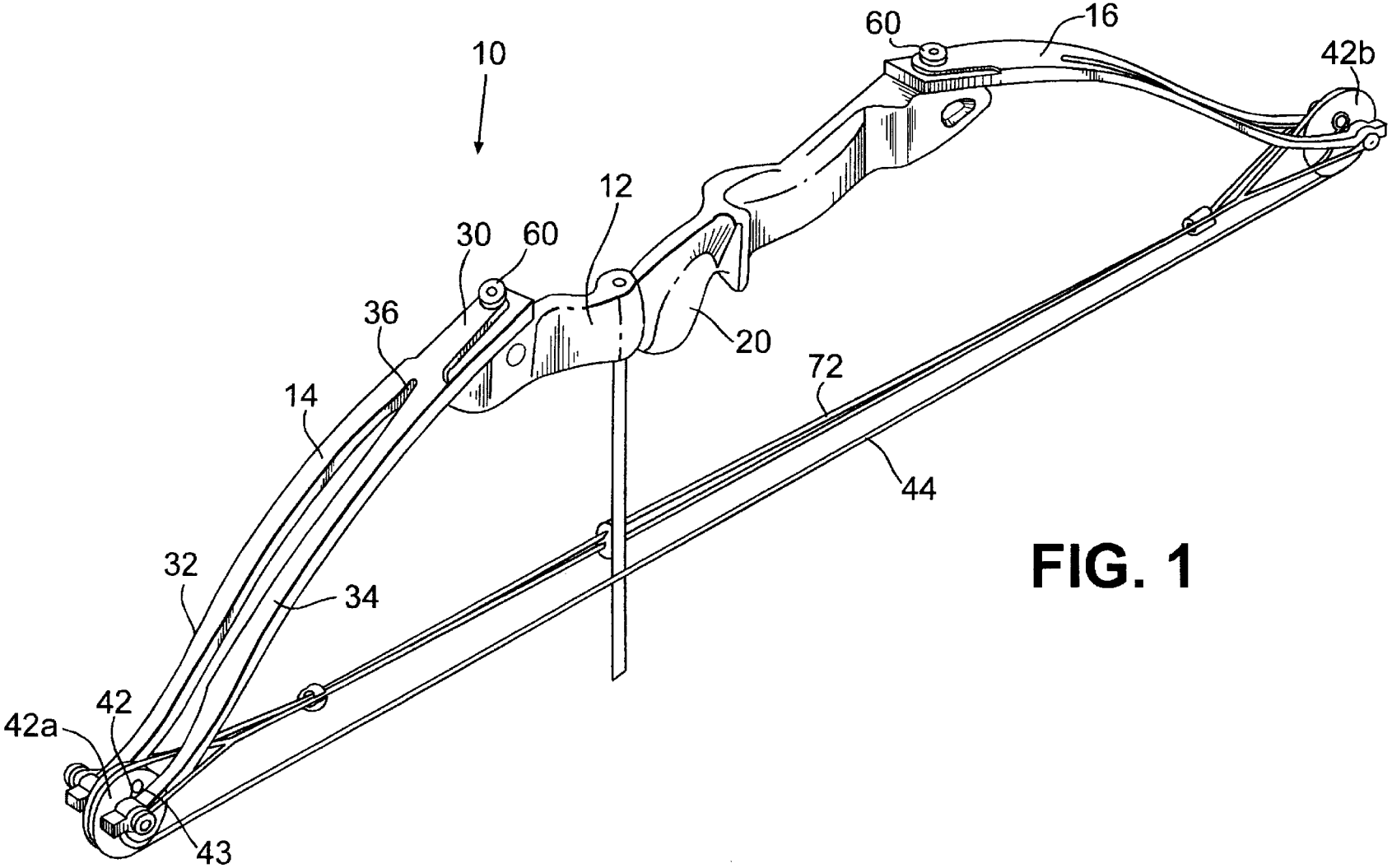
FIG. 1 shows a perspective view of an embodiment of the compound archery bow of the present invention.
Figure 2:
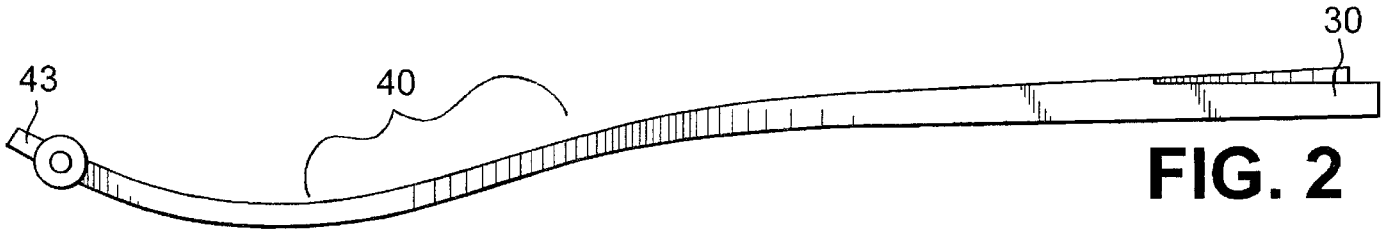
FIG. 2 shows a side view of one limb of the compound archery bow of the present invention.
Figure 3:
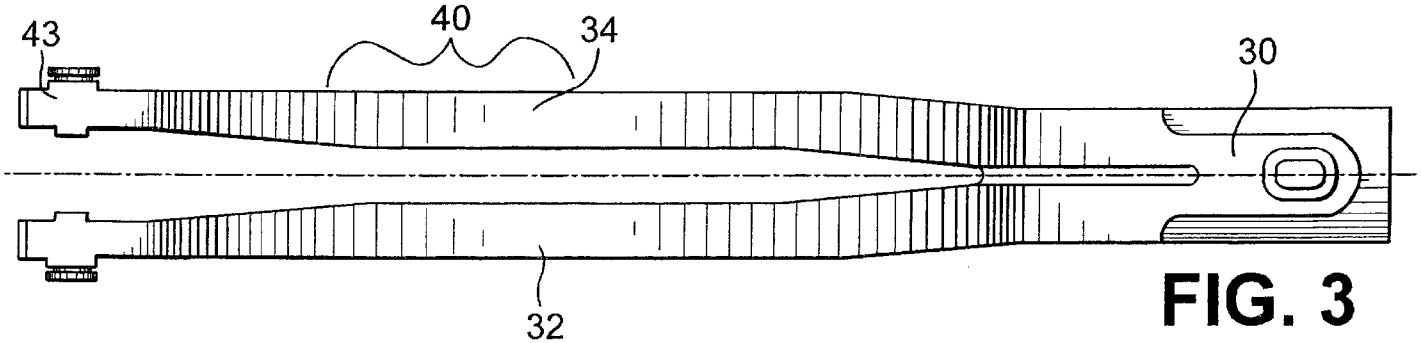
FIG. 3 shows a top view of one limb of the compound archery bow of the present invention.
Figure 4:
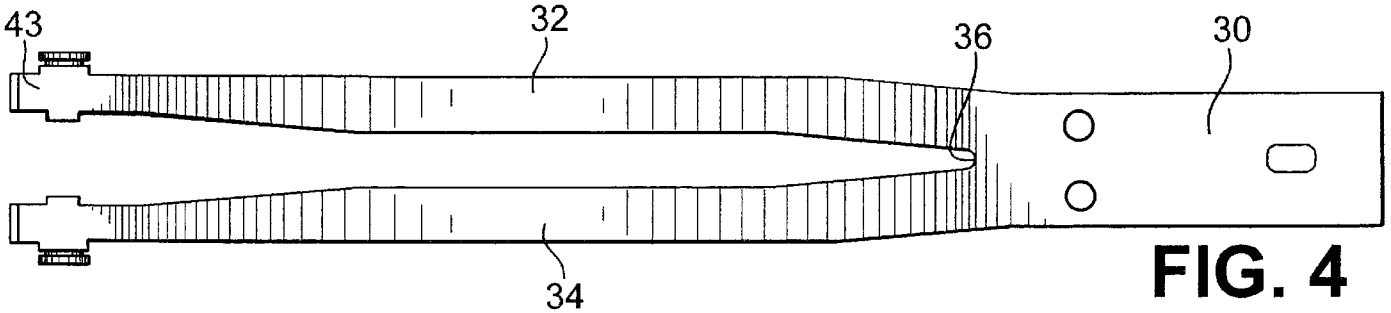
FIG. 4 shows a bottom view of one limb of the compound archery bow of the present invention.
Figure 5:
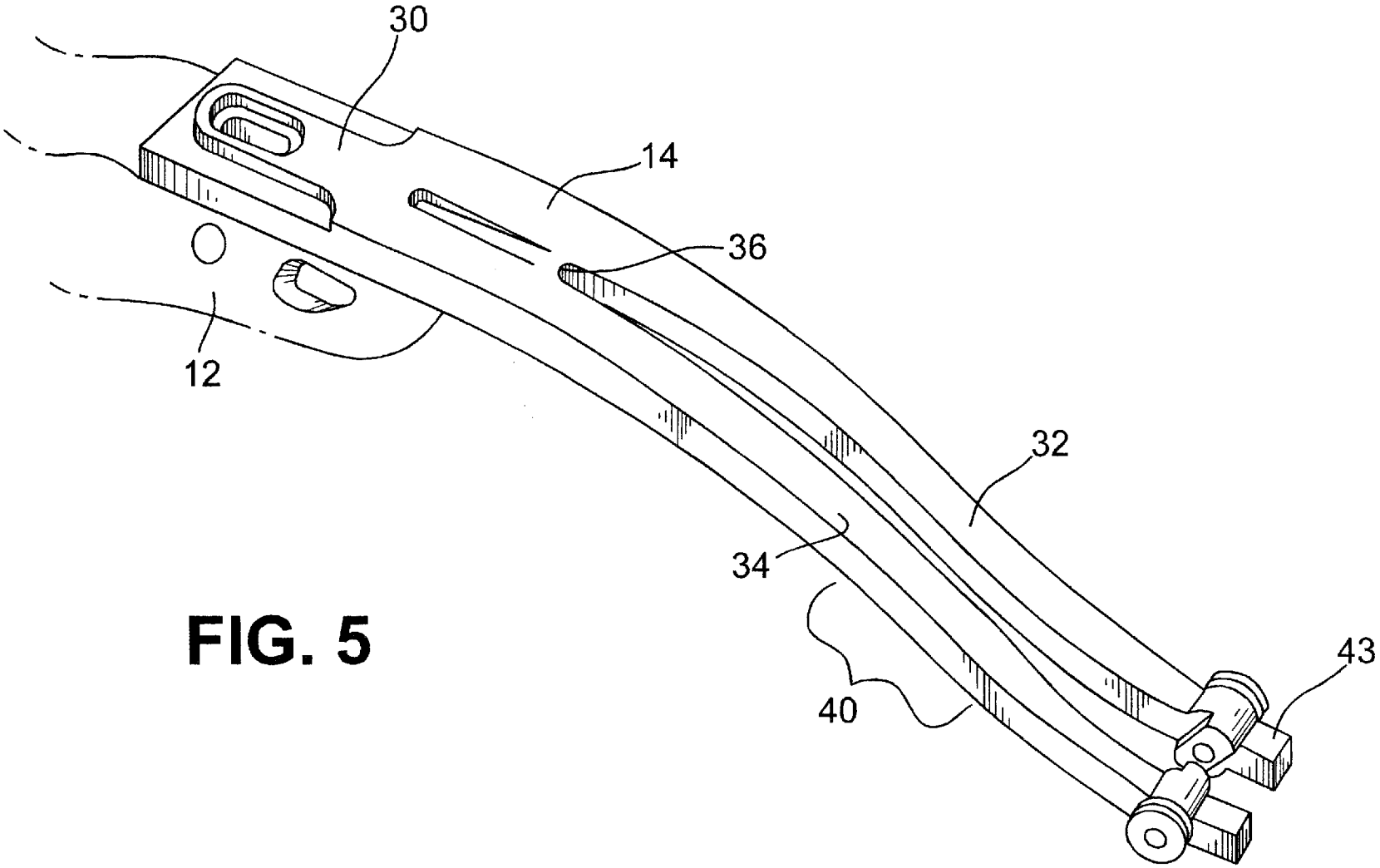
FIG. 5 shows a perspective view of one limb of the compound archery bow of the present invention.

FIG. 1 shows a compound archery bow 10. The bow has a handle riser 12 which is preferably made of a rigid material such as aluminum or injection molded plastic. The archery bow also includes two bow limbs 14 and 16, one on each side of the handle riser 12. The bow limbs are constructed of fiber reinforced plastic such as nylon 6/6 with a 60% short glass fiber reinforcement which is injection molded. Other suitable materials include nylon 6/6 with 50% long glass fibers and Griveroy with 50% short glass fibers. Preferably, the bow limbs are formed by injection molding as described in U.S. Pat. No. 5,534,213, the disclosure of which is hereby incorporated by reference. The handle riser 12 includes a handgrip 20. The bow limbs 14 and 16 are mirror images of one another. Therefore, the details of bow limb 14 are described in detail, it being understood that the bow limb 16 has identical parts. Bow limb 14 includes a base portion 30 and two limb sections 32 and 34 integrally connected with the base portion 30. The base portion 30 is connected to the handle riser 12 by a button 60, in a conventional manner. The button 60 is insertable through the base portion 30. A threaded bolt (not shown) attaches the button 60 to the handle riser 12. The limb sections 32 and 34 meet the base 30 at a fork 36. The limb sectibons 32 and 34 include a working section 40 which is reduced in thickness from the remainder of the limb. The majority of the flexing of the limb occurs in the working portion. The thickness of the working portion is typically about one tenth of an inch thinner than the remainder of the limb. This thickness differential could be more or less than one tenth of an inch depending on design and materials. A cam pulley 42, is mounted on the tip portion 43 of the limb 14. The bow 10 has conventional rigging of tension cables and bowstring, as is known in the art. One method of rigging is described in U.S. Pat. No. 5,881,705, co-owned with the present application, the disclosure of which is hereby incorporated by reference. A bow string 44 connects cam pulleys 42*a* and 42*b*. A tension cable 72 also connects the cam pulleys 42*a* and 42*b*. As the bowstring 44 is drawn, the limbs 14 and 16 flex in their working portions 40. Energy is stored in the bow limbs 14 and 16, by the bending of the bow limbs 14 and 16 in their working portions. When the bowstring 44 is released, the limbs 14 and 16 return to their unflexed condition, thus transferring the stored energy to the bowstring 44 and, hence, the arrow (not shown).

What is claimed is:

1. A compound archery bow comprising:

a handle-riser;

two bow limbs attached to said handle riser, said bow limbs projecting outwardly from said handle riser, each of said bow limbs comprising a pair of resilient limb members joined to and integral with a base portion, forming a fork;

a pulley attached to each of said bow limbs;

a bowstring and cable assembly strung between said pulleys; and a working portion of each of said bow limbs, disposed between each said pulley and said fork.

2. The compound archery bow of claim 1 wherein the bow limbs are constructed by injection molding.

3. The compound archery bow of claim 2 wherein the limbs are constructed of fiber reinforced plastic.

4. The compound archery bow of claim 3 wherein the fiber reinforced plastic is nylon 6/6 with about 60% short glass fiber reinforcement.

5. The compound archer bow of claim 3 wherein the fiber reinforced plastic is nylon 6/6 with about 50% long glass fibers.

* * * * *